US010371130B2

(12) United States Patent
Deng et al.

(10) Patent No.: US 10,371,130 B2
(45) Date of Patent: Aug. 6, 2019

(54) MAGNETIC PISTON SHOE PAIR FOR AXIAL PISTON PUMP AND MOTOR AND CONTROL METHOD THEREOF

(71) Applicant: Anhui University of Science and Technology, Huainan (CN)

(72) Inventors: Haishun Deng, Huainan (CN); Yongkang Yang, Huainan (CN); Haifeng Wang, Huainan (CN); Qingchun Wang, Huainan (CN); Feiyu Mao, Huainan (CN); Chunyan Wang, Huainan (CN); Shiju He, Huainan (CN); Tao Wang, Huainan (CN)

(73) Assignee: ANHUI UNIVERSITY OF SCIENCE AND TECHNOLOGY, Huainan (CN)

( * ) Notice: Subject to any disclaimer, the term of this patent is extended or adjusted under 35 U.S.C. 154(b) by 0 days.

(21) Appl. No.: 16/203,618

(22) Filed: Nov. 29, 2018

(65) Prior Publication Data

US 2019/0145386 A1 May 16, 2019

Related U.S. Application Data

(63) Continuation of application No. PCT/CN2018/073223, filed on Jan. 18, 2018.

(30) Foreign Application Priority Data

Nov. 10, 2017 (CN) ..... 2017 1 1106150

(51) Int. Cl.
*F04B 1/12* (2006.01)
*F04B 53/18* (2006.01)

(52) U.S. Cl.
CPC ..... *F04B 1/126* (2013.01); *F04B 53/18* (2013.01); *F05B 2260/302* (2013.01); *F05B 2260/98* (2013.01)

(58) Field of Classification Search
CPC ..... F04B 1/126; F04B 53/18; F04B 1/2007; F05B 2260/302; F05B 2260/98
See application file for complete search history.

(56) References Cited

U.S. PATENT DOCUMENTS 5,877,577 A * 3/1999 Ishizaki ..... F04B 49/002 310/261.1
2006/0097604 A1* 5/2006 Adaniya ..... H02K 21/024 310/261.1

FOREIGN PATENT DOCUMENTS

CN 1847649 A 10/2006
CN 103410655 A 11/2013
CN 104675691 A * 6/2015
(Continued)

*Primary Examiner* — Abiy Teka
(74) *Attorney, Agent, or Firm* — Gokalp Bayramoglu

(57) ABSTRACT

A magnetic piston shoe pair for an axial piston pump and the motor includes: pistons, coil suites, piston shoes and a swash plate, wherein the interior of the coil suite is a closed coil; the bearing surface that the end surface of the swash plate abuts the piston shoe is provided with micro-molding holes; the micro-molding holes are hemispherical; the back surface of the swash plate is provided with a primary iron core and two secondary iron cores; the iron cores are wound with coil; the coil is connected to an external alternating current power supply. When the pump/motor is working, the coil is energized to generate a magnetic field, thereby adsorbing the piston shoe on the swash plate. Meanwhile, the coil suite generates an inductive magnetic field.

6 Claims, 3 Drawing Sheets

(56) References Cited

FOREIGN PATENT DOCUMENTS

| | | | | | |
|---|---|---|---|---|---|
| CN | 104675691 | A | | 6/2015 | |
| CN | 204493168 | U | | 7/2015 | |
| CN | 105317670 | A | | 2/2016 | |
| CN | 106870314 | A | | 6/2017 | |
| DE | 617689 | C | * | 8/1935 | ..... F04B 1/126 |
| KR | 100991513 | B1 | | 11/2010 | |

* cited by examiner

MAGNETIC PISTON SHOE PAIR FOR AXIAL PISTON PUMP AND MOTOR AND CONTROL METHOD THEREOF

CROSS REFERENCE TO RELATED APPLICATIONS

This non-provisional patent application is a continuation application of International Application No. PCT/CN2018/073223, filed on Jan. 18, 2018, which is based upon and claims priority to Chinese Patent Application No. CN201711106150.0, filed on Nov. 10, 2017, the entire contents of which are incorporated herein by reference.

TECHNICAL FIELD

The present invention relates to the technical field of an axial piston pump and motor, and in particular to a magnetic piston shoe pair for an axial piston pump and a motor and a control method thereof.

BACKGROUND

The axial piston pump/motor is one of the most important power components and executive components in the hydraulic system, is widely applied in the industrial, agricultural, coal mine, military and other hydraulic systems, and is one of the two most widely used hydraulic components in modern hydraulic components. Meanwhile, due to the complicated structure of the axial piston pump/motor and the high requirements on the manufacturing technique and the materials, it is one of the hydraulic components with high technical content.

In recent years, with the rapid growth of China's economy and the development of materials, manufacturing, electronics and other technologies, in the process of industrial modernization and large-scale urbanization, the demand for axial piston pumps/motors is great in the field of engineering machinery, plastic machinery, metallurgy, machine tools and agricultural machinery. Thus, the axial piston pumps/motors still require constant technological innovations and structural improvements.

The piston shoe pair is one of the key friction pairs of the axial piston pump/motor, and is the direct bearer of the oil pressure in the piston cavity, which is extremely easy to become worn and fail. Therefore, the underside of the piston shoe must maintain the necessary lubrication state, and form a certain thickness of the oil film to ensure the liquid lubrication, so as to prevent the piston shoe from directly contacting the swash plate. The lubrication oil film should not be too thin, which is easy to lead to wear or failure. The lubrication oil film should not be too thick, which will reduce the volumetric efficiency of the piston pump, and even fail to establish the pressure adequate to the load. By means of the spring force, the main hydraulic pressure and the depressurized hydraulic pressure within the damping hole, the piston shoe pair structure of the traditional axial piston pump/motor forms a hydrostatic back-up and enable the pressing force to be slightly larger than the separating force, so as to ensure that the piston is pressed tightly on the oblique plane of the swash plate. The existing axial piston pump/motor presses the retainer plate through the spring on the transmission shaft, and the retainer plate presses the piston shoe and the piston, resulting in complicated force on the retainer plate and the higher fault rate.

The Chinese patent application No. 201510092027.2 discloses electromagnetic preloading piston shoe pair used in an axial piston pump and a motor, including a piston and a swash plate. One end of the piston abuts the surface of the swash plate through a piston shoe. The rear surface of the swash plate is provided with a boss. The boss is wound by coils. The coils are electrically connected to an external alternating current power supply. The patent utilizes the electromagnetic force to provide the preload force, which effectively solves the problem that the traditional piston shoe pair of the balanced-type multi-ring axial piston pump or the double-side driving piston motor has difficulty in designing, and optimizes the structure of the balanced-type multi-ring axial piston pump or the double-side driving piston motor. However, the following problems still need to be solved.

First, the electromagnetic force enables the piston shoe pair to attach on the swash plate by means of attractive force. When the oil film thickness decreases, the electromagnetic force increases, and the oil film thickness can only be maintained by its stiffness, thereby increasing the difficulty of maintaining the stable oil film thickness.

Second, the electromagnetic force distribution is not ideal enough, and the electromagnetic force fluctuates greatly along the circular motion direction of the piston shoe pair, which is adverse to the stable operation of the piston shoe pair.

Thirdly, the electromagnetic force is used in a single way, and only adsorbs the piston shoe, which fails to adapt the force condition of the piston shoe in the complicated operating process of the axial piston pump/motor, and fails to improve the wear situation of the bearing surface of the piston shoe.

In the cases of the above-mentioned problems, it is necessary to propose new structures and new technical means to further improve the working performance of the magnetic piston shoe pair.

SUMMARY

The object of the present invention is to provide a magnetic piston shoe pair for an axial piston pump and a motor and a control method thereof in order to solve the above-mentioned problems. The present invention changes the manner that the traditional axial piston pump/motor tightly presses the retainer plate and the piston shoe by means of spring, and uses the energization of the primary iron-core coil to achieve the magnetic preloading of the initial motion of the piston shoe pair. The present invention adjusts the current of the coils in the primary iron core and the secondary iron core to reduce the fluctuation of the piston shoe when the piston shoe is working. Through a magnetic field generated by the energized coil and an inductive magnetic field generated by a coil suite on the piston, the present invention adapts the complicated force condition of the piston shoe when the axial piston pump/motor is working. When the distance between the piston shoe and the swash plate is too short, the magnetic field is in the same direction as the inductive magnetic field, and a repulsive force is generated. When the distance between the piston shoe and the swash plate is too large, the direction of the magnetic field is opposite to the direction of the inductive magnetic field, and attractive force is generated. The interaction among the electromagnetic force, the main hydraulic pressure and the depressurized hydraulic pressure within the damping hole achieves hydrostatic back-up. The present invention changes the structure of the bearing surface of the piston shoe, and a sufficient stable oil film between the piston shoe and the swash plate can be formed through the micro-molding hole, which improves the supporting force of the oil film, decrease the friction coefficient, alleviate the wear phenomenon on the piston shoe pair generated by the instability of the oil pressure and the inaccuracy of the structure piston shoe pair.

The present invention achieves the above-mentioned objects by the following technical solutions. A magnetic piston shoe pair for an axial piston pump and a motor includes a primary iron core, two secondary iron cores, coils, a swash plate, micro-molding holes, an annular pressing plate, a piston shoe, a coil suite, a piston, a cylinder, a spring, a transmission shaft, and a distributor plate. The primary iron core is configured at a central position of a back surface of the swash plate; the two secondary iron cores are symmetrically distributed on both sides of the primary iron core, and respectively located between a low pressure zone and a high pressure zone of a piston pair working area; the coils are wound around the primary iron core and the secondary iron cores; and the coils are electrically connected to an external alternating current power supply.

Preferably, the piston is sleeved with the coil suite, the coil suite and the piston are in an interference fit, and an interior of the coil suite is a closed coil.

Preferably, the swash plate is provided with the micro-molding holes on an annular bearing surface that the swash plate abuts the piston shoe.

Preferably, the secondary iron cores are symmetrically distributed on the both sides of the primary iron core, and the diameter and height of the secondary iron cores are smaller than the primary iron core.

Preferably, the micro-molding holes of the bearing surface of the swash plate are hemispherical.

The present invention further discloses a control method of a magnetic piston shoe pair for an axial piston pump. The control method includes the following steps.

S1: when the axial piston pump/motor starts, the coil on the primary iron core is supplied with alternating current, and the piston shoe pair is tightly adsorbed on an annular oblique plane of the swash plate;

S2: when the piston pair is located in the low pressure zone, the coil on the secondary iron core in the low pressure zone is supplied with current, which increases the electromagnetic attractive force of the swash plate to the piston shoe, and balances an oil film thickness between the piston shoe and the swash plate;

S3: when the piston pair is located in the high pressure zone, the coil on the secondary iron core in the high pressure zone is supplied with reverse current, which decreases the electromagnetic attractive force of the swash plate to the piston shoe, and balances the oil film thickness between the piston shoe and the swash plate;

S4: When the oil film is too thick, the coils of the primary/secondary iron core on the swash plate are energized, and two inductive magnetic fields are generated by the coils and the coil suite on the piston. When a gap between the swash plate and the piston shoe is too large, and the two inductive magnetic fields are attracted to each other to reduce the oil film thickness; and S5: When the oil film is too thin, the gap between the swash plate and the piston shoe is too small, so that the two inductive magnetic fields repulse each other and increase the oil film thickness.

The entire process can be controlled by adjusting the current of the coil on the primary iron core.

In consideration of the complicated situation that the piston cavity has high and low pressure during the working of the axial piston pump, different magnitudes of current can be supplied to the coils of the primary iron core and the secondary iron cores, thereby generating different magnitudes of electromagnetic forces to match operation conditions of the each piston shoe pair in different regions.

The beneficial effects of the present invention are:

First, in the present invention, the piston shoe pair is pushed on the swash plate by the electromagnetic force in the form of attractive force to achieve the magnetic preloading during the initial motion of the piston shoe pair. And a repulsive force can be generated when the oil film is too small, which can effectively prevent the oil film from being too thin. During the operating process of the magnetic piston shoe pair, according to the electromagnetic induction principle, the transformation process of the electromagnetic attraction and the electromagnetic repulsion provides a feedback for the operation of the magnetic piston shoe pair to adapt the complicated operation condition of the axial piston pump/motor.

Second, in the present invention, according to the stress condition of the piston shoe pair, a primary iron core is configured on the center of the back surface of the swash plate, and two secondary iron cores are symmetrically distributed on both sides of the primary iron core, and respectively located between the low pressure zone and the high pressure zone of the piston pair working area, thereby matching with the operation condition of the piston shoe pair. The iron core is wound by the coil and is energized by different currents, according to the complicated situation of the high and low pressure of the piston cavity, which improves the distribution of the electromagnetic force, reduces the fluctuation of the electromagnetic force in the direction of the circular motion of the piston shoes, and ensures the stable operating state of the piston shoe pair.

Thirdly, in the present invention, the micro-molding hole is configured on the swash plate, which reduces the processing difficulty, facilitates to increase the processing precision, improves the bearing surface of the piston shoes in contact with the swash plate, increases the stiffness of the oil film between the piston shoe pair and the swash plate, reduces the friction coefficient and improves the wear situation of the bearing surface of the piston shoe.

Fourth, in the present invention, the micro-molding hole is configured on the swash plate, which enables the piston shoe pair more likely to generate a negative feedback during the operating process, so that the transformation between the electromagnetic attraction and the electromagnetic repulsion is more sensitive.

1: primary iron core;

2: secondary iron core;

3: coil;

4: swash plate;

41: first pressure zone;

42: second pressure zone;
5: micro-molding hole;
6: annular pressing plate;
7: piston shoe;
8: coil suite;
9: piston;
10: cylinder;
11: spring;
12: transmission shaft; and
13: distributor plate.

DETAILED DESCRIPTION OF THE EMBODIMENTS

The technical solutions in the embodiments of the present invention are clearly and completely described below with reference to the drawings in the embodiments of the present invention. It is obvious that the described embodiments are merely a part of the embodiments of the present invention instead of all embodiments. Based on the embodiments of the present invention, all other embodiments obtained by the persons skilled in the art without creative efforts are within the protection scope of the present invention.

Figure 1:
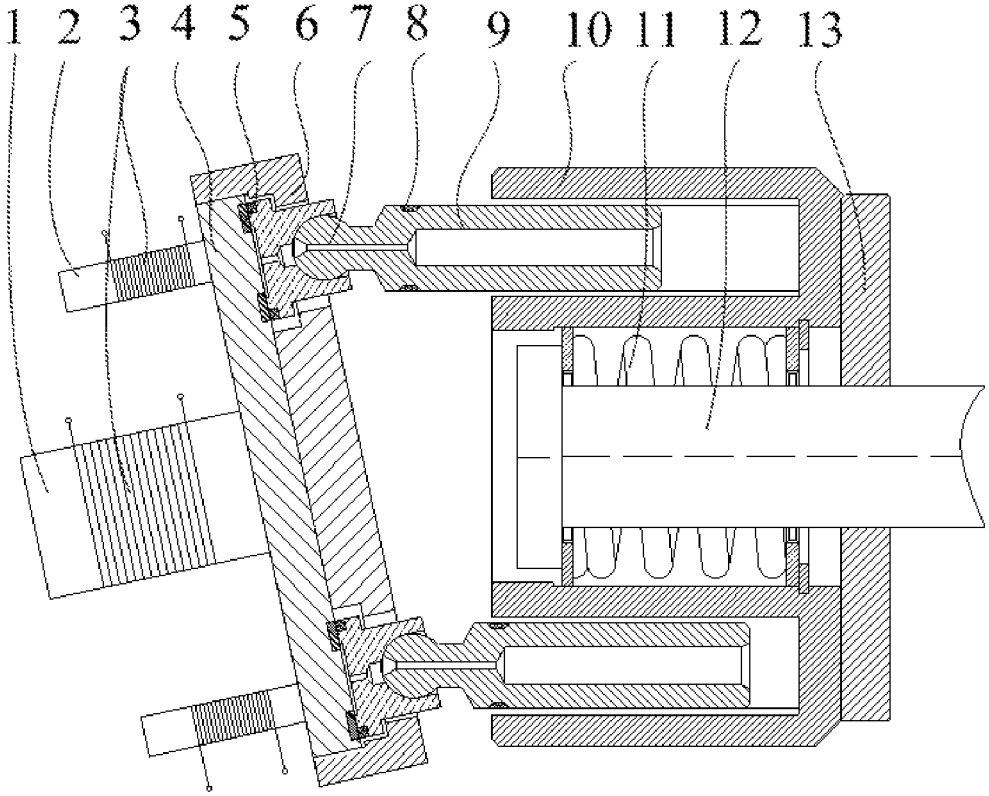
FIG. 1 is a structural schematic diagram showing the assembly of the present invention.
Figure 2:
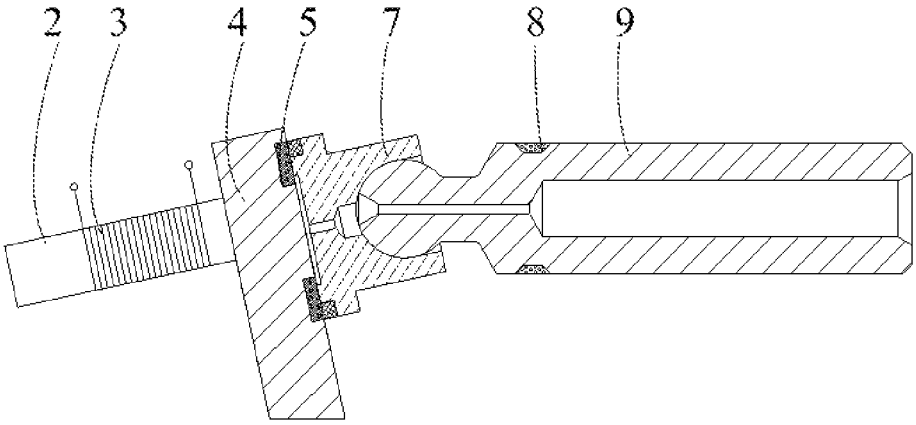
FIG. 2 is a partial structural schematic diagram showing the swash plate and the piston shoe pair of the present invention.
Figure 3:
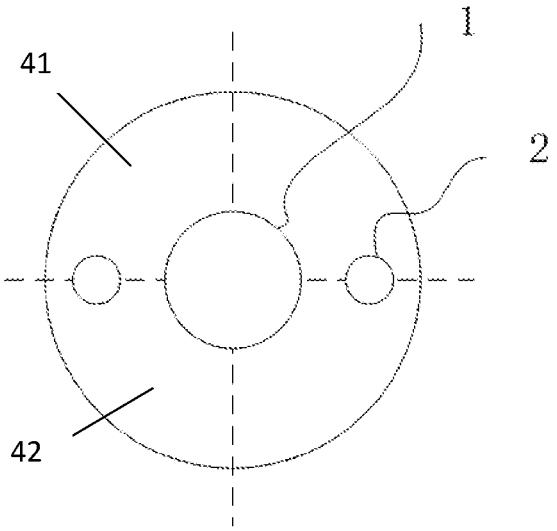
FIG. 3 is a schematic diagram showing the distribution of the iron core on the back of the swash plate of the present invention.
Figure 4:
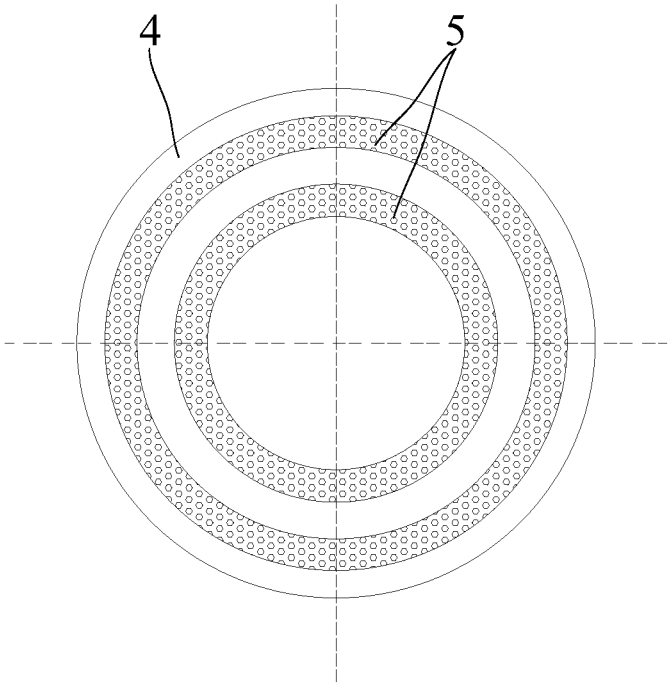
FIG. 4 is a structural schematic diagram showing the bearing surface of the swash plate of the present invention.
Figure 5:
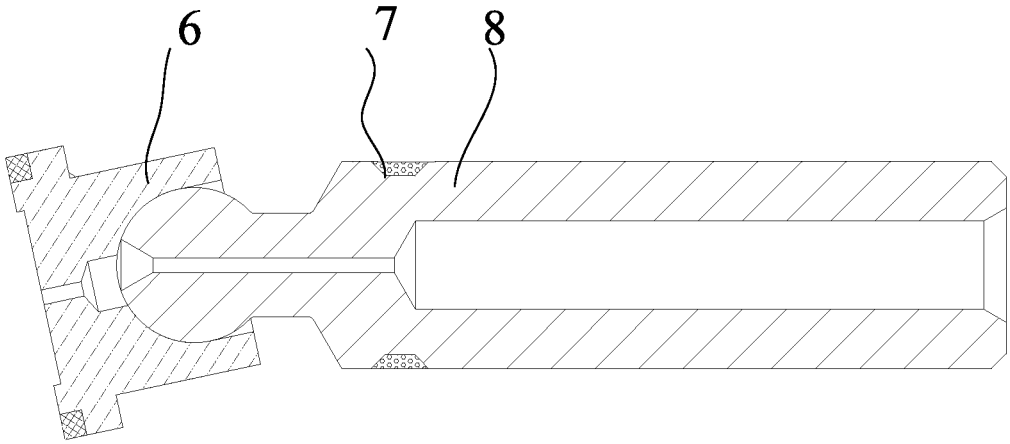
FIG. 5 is a structural schematic diagram showing the piston shoe pair of the present invention.

Referring to FIG. 1, FIG. 2, FIG. 3, FIG. 4 and FIG. 5: a magnetic piston shoe pair for an axial piston pump and a motor includes primary iron core 1, secondary iron cores 2, and coil 3, swash plate 4, micro-molding hole 5, annular pressing plate 6, piston shoes 7, coil suite 8, piston 9, cylinder 10, spring 11, transmission shaft 12, and distributor plate 13, characterized in that: the primary iron core 1 is configured on the center of the back side of the swash plate 4, and two same secondary iron cores 2 are configured at the symmetric positions on both sides of the primary iron core; the two same secondary iron cores 2, respectively located between the first pressure zone 41 and the second pressure zone 42 in the working area of the piston pair; the first pressure 41 is a low pressure zone, and the second pressure zone 42 is a high pressure zone; the primary iron core 1 and the secondary iron core 2 is wound by coils 3; the coil is connected to an external alternating current power supply; the micro-molding hole 5 is configured on the bearing surface of the swash plate.

The specific working process of the control method is as follow:

S1: When the axial piston pump/motor is started, the coil 3 on the primary iron core 1 is supplied with alternating current, so that the coil 3 generates an inductive magnetic field, the piston shoe pair is tightly adsorbed on the annular oblique plane of the swash plate 4, which provides a magnetic preloading of the initial motion of the piston shoe pair. Therefore, when the piston shoe 7 is to be operated, the piston shoe 7 is subject to the oil pressure in the piston cavity, the supporting force of the swash plate 4 to the piston shoe 7, and the electromagnetic force generated on the coil 3 to form a hydrostatic back-up.

S2: When the piston pair is located in the first pressure zone 41, the external load force decreases, the flow of the oil through the damping hole increases, and the pressure drop generated by the damper tube also increases, resulting in a pressure decrease of the oil chamber of the piston shoe 7 and a thickness increase of the oil film. At this time, the coil 3 on the secondary iron core 2 in the first pressure zone 41 is energized, which increases the electromagnetic attractive force of the swash plate to the piston shoe, and balances the external load force by using the electromagnetic force and the hydraulic pressure, so as to prevent the oil film thickness from increasing to make the oil film balanced at a new oil film thickness.

S3: When the piston pair is located in the second pressure zone 42, the external load force increases, the flow of the oil through the damping hole decreases, and the pressure drop generated by the flow of the damping pipe also decreases, resulting in a pressure increase of the oil chamber of the piston shoe 7 and a thickness decrease of the oil film. At this time, the coil 3 on the secondary iron core 2 in the second pressure zone 42 is supplied with a reverse current, which decreases the electromagnetic attractive force of the swash plate 4 to the piston shoe 7, so as to prevent the oil film thickness from decreasing to make the oil film balanced at a new oil film thickness.

S4: When the oil film is too thick, an inductive magnetic field is generated by the core coil 3 on the swash plate 4 and the coil suite 8 on the piston 9 since the core coil 3 on the swash plate 4 is energized. When the oil film thickness is too thick, the gap between the swash plate 4 and the piston shoe 7 is too large, so that the two inductive magnetic fields attract each other to decrease the thickness of the oil film.

S5: When the oil film is too thin, the gap between the swash plate 4 and the piston shoe 7 is too short, so that the two inductive magnetic fields repulse each other to increase the oil film thickness. The axial piston pump/motor includes a transmission shaft 12, a cylinder 10, and a distributor plate 13. One end of the transmission shaft 12 is disposed inside the cylinder 10, and is connected to the distributor plate 13; the other end passes through the swash plate 4 and the compression spring 11. At this time, the compression spring 11 merely keeps the cylinder 10 in a floating state, and ensures the hydrostatic back-up of the distributor pair rather than the spring 11 on the existing piston shoe pair to press the retainer plate, thereby effectively preventing interaction effect between the operating state of the distributor pair and the operating state of the piston shoe pair of the axial piston pump/motor, and improving the working performance of distributor pair and the piston shoe pair of the axial piston pump/motor.

S6: The alternating current of the coil 3 on the primary iron core 1 can be adjusted in the whole working process of the piston shoe pair to cooperate with the above-mentioned adjustment mode, so that the piston shoe pair is always in the best working state.

The bearing surface that the end surface of the swash plate 4 contacts the piston shoe 7 is provided with micro-molding holes 5. The micro-molding holes are hemispherical. The micro-molding holes 5 can sensitively provide conditions for electromagnetic force feedback and improve the oil film rigidity, which facilitates to form a hydrodynamic effect in the working process of the piston shoe pair.

For the person skilled in the art, it is obvious that the present invention is not limited to the details of the above-mentioned exemplary embodiments, and the present invention can be implemented in other specific forms within the spirit or essential features of the present invention. Thus, in any case, the embodiments should be considered as exemplary and not restrictive. The protection scope of the present invention is limited by the claims instead of the above-mentioned description. Therefore, all varieties within the same meaning and scope of equivalent elements are included in the present invention. Any reference signs in the claims should not be regarded as limiting the involved claim.

In addition, it should be understood that although the specification is described in terms of embodiments, not every embodiment includes only one independent technical solution. The description mode of the specification is merely used for clarity. The person skilled in the art should regard the specification as a whole. The technical solutions in the respective embodiments may also be combined appropriately to form other embodiments that can be understood by the person skilled in the art.

We claim:

1. A magnetic piston shoe pair for an axial piston pump and a motor, comprising a primary iron core, two secondary iron cores, coils, a swash plate, micro-molding holes, an annular pressing plate, piston shoes, coil suites, pistons, cylinders, a spring, a transmission shaft, and a distributor plate, wherein the primary iron core is configured at a central position of a back surface of the swash plate; the two secondary iron cores are symmetrically distributed on both sides of the primary iron core, and respectively located between a first pressure zone and a second pressure zone of a piston pair working area; the coils are wound around the primary iron core and the secondary iron cores; and the coils are electrically connected to an external alternating current power supply.

2. The magnetic piston shoe pair for the axial piston pump and the motor according to claim 1, wherein the piston is sleeved with the coil suite, and an interior of the coil suite is a closed coil.

3. The magnetic piston shoe pair for the axial piston pump and the motor according to claim 1, wherein the micro-molding holes are configured on an annular bearing surface that the swash plate abuts the piston shoe.

4. The magnetic piston shoe pair for the axial piston pump and the motor according to claim 1, wherein the diameter and height of the secondary iron core are smaller than the primary iron core.

5. The magnetic piston shoe pair for the axial piston pump and the motor according to claim 1, wherein the micro-molding holes of the annular bearing surface of the swash plate are hemispherical.

6. A control method for the magnetic piston shoe pair for the axial piston pump and the motor according to claim 1, wherein the control method comprises:

S1: when the axial piston pump or the motor starts, the coil on the primary iron core is supplied with alternating current, and the piston shoe is tightly adsorbed on an annular oblique plane of the swash plate;

S2: when the piston pair is located in the first pressure zone, the coil on the secondary iron core in the first pressure zone is supplied with current, which increases an electromagnetic attractive force of the swash plate to the piston shoe, and balances an oil film thickness between the piston shoe and the swash plate;

S3: when the piston pair is located in the second pressure zone, the coil on the secondary iron core in the second pressure zone is supplied with reverse current, which decreases the electromagnetic attractive force of the swash plate to the piston shoe, and balances the oil film thickness between the piston shoe and the swash plate;

S4: when the oil film is too thick, the coils of the primary core and the secondary iron cores on the swash plate are energized, and two inductive magnetic field are respectively generated by the coil suite on the piston and the coils; when a gap between the swash plate and the piston shoe is too large, and the two inductive magnetic fields attract each other to reduce the oil film thickness; and S5: when the oil film is too thin, the gap between the swash plate and the piston shoe is too small, so that the two inductive magnetic fields repulse each other and increase the oil film thickness;

an entire process is controlled by adjusting the current of the coil on the primary iron core.

* * * * *